US006966840B2

(12) United States Patent
Nelson

(10) Patent No.: US 6,966,840 B2
(45) Date of Patent: Nov. 22, 2005

(54) AMUSEMENT DEVICE THAT SENSES ODOROUS GASES IN A BATHROOM

(76) Inventor: Webb T. Nelson, 19180 144$^{th}$ Ave. NE., Woodinville, WA (US) 98072

( * ) Notice: Subject to any disclaimer, the term of this patent is extended or adjusted under 35 U.S.C. 154(b) by 199 days.

(21) Appl. No.: 10/041,430

(22) Filed: Jan. 10, 2002

(65) Prior Publication Data

US 2003/0130049 A1 Jul. 10, 2003

(51) Int. Cl.$^{7}$ ..... A63H 37/00
(52) U.S. Cl. ..... 472/56; 446/175
(58) Field of Search ..... 472/51, 2, 53, 472/56, 52; 446/175; 4/213, 217

(56) References Cited

U.S. PATENT DOCUMENTS 4,944,045 A * 7/1990 Agelatos et al. ..... 4/213
5,117,676 A * 6/1992 Chang ..... 73/40.5 A
5,316,516 A * 5/1994 Saitoh ..... 40/414
5,416,724 A * 5/1995 Savic ..... 702/51
5,452,481 A * 9/1995 Meyer ..... 4/213
5,764,150 A * 6/1998 Fleury et al. ..... 340/632
6,489,787 B1 * 12/2002 McFadden ..... 324/725

* cited by examiner

*Primary Examiner*—Kien Nguyen
(74) *Attorney, Agent, or Firm*—LaMorte & Associates

(57) ABSTRACT

A novelty device that makes humorous statements when a person is having a bowel movement in a confined bathroom. The device includes an automated character, such as a bird in a birdcage, a skunk with a gasmask or some other character. Within the device is a gas sensor for detecting at least one gas emitted during a bowel movement. The device also includes a speaker for transmitting an audible message. When gases from a bowel movement are detected, audible statements are transmitted and synchronized movements are effected in the automated character.

16 Claims, 2 Drawing Sheets

AMUSEMENT DEVICE THAT SENSES ODOROUS GASES IN A BATHROOM

BACKGROUND OF THE INVENTION

1. Field of the Invention

The present invention relates to amusement devices that make humorous statements when activated. More particularly, the present invention relates to the configuration of such amusement devices and the mechanisms used to activate such amusement devices.

2. Prior Art Statement

The prior art is replete with different types of amusement devices that contain voice synthesizer circuitry that is used to make humorous statements when activated. Such prior art devices have been built into greeting cards, toy dolls, pillows and near countless other varieties of novelty items.

However, with most such prior art amusement devices, the amusement device must be manually activated by a person manipulating the amusement device. For example, if voice synthesizer circuitry is added to a doll, the circuitry is typically activated when the doll is squeezed in a certain area or otherwise manually manipulated. If voice synthesizer circuitry is added to a greeting card, the circuitry is activated when the greeting card is opened.

Since most prior art amusement devices must be manually activated, the broadcasting of a message by the voice synthesizer circuitry is often anticipated. For example, when a child wants a doll to speak, that child purposely squeezes the doll and expects to hear the doll speak. However, as is well known in comedy, timing is everything. It is often much more humorous to have a novelty item begin to broadcast a message when a person is not expecting it rather than when a person is expecting the broadcast.

In order for a novelty device to broadcast a message without physical manipulation, that novelty device must contain some type of passively activated controller. Most often, the passively activated controllers used in toys and other amusement devices are timers, motion detectors and sound detectors. Timers activate the device at a preselected time. Motion sensors activate the device when movement near the device is detected. Sound detectors activate the device when sound is detected around the device.

Timers are not often used in novelty items that are intended to be humorous. This is because the proper timing of when a novelty device should activate is too hard to predict. Furthermore, the novelty device could activate when no one is around, thereby quickly draining batteries. Adversely, novelty devices with motion sensors and sound detectors are commonly used. However, they too have limitations. There is a fine line between a novelty device that is funny and a novelty device that is annoying. Novelty devices with motion detectors can detect whether or not a person is approaching, however, the novelty device cannot tell in what activity that person is engaged. Furthermore, such novelty devices with motion detectors cannot tell the difference between an approaching person or the family pet. As such, by activating at the wrong times, novelty devices with motion detectors can quickly become annoying. Similarly, novelty devices with sound detectors cannot tell the difference between a person's voice and a voice on the television. Therefore, such novelty devices also commonly activate at the wrong times and become annoying.

The present invention is a novelty device that passively detects when a person in a bathroom is having a bowel movement and provides humorous statements appropriate for the occasion. Since the location and activity of the person can be accurately ascertained when the novelty device is activated, the ability of the novelty device to be perceived as humorous is greatly increased. This new novelty device and its associated method of use are set forth in the specification and claims presented below.

SUMMARY OF THE INVENTION

The present invention is a novelty device that makes humorous statements when a person is having a bowel movement in a confined bathroom. The device includes an automated character, such as a bird in a birdcage, a skunk with a gasmask or some other character. Within the device is a gas sensor for detecting at least one gas emitted during a bowel movement. The device also includes a speaker for transmitting an audible message once such gases are detected.

To use the novelty device, the novelty device is placed in a bathroom. In the bathroom, the device samples the ambient air. If gases associated with a bowel movement are detected, the novelty device begins to emit humorous statements regarding the bodily function being performed in the bathroom. The emitted statement can be accompanied with synchronized movements in the automated character.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention device can be configured in many different amusing ways, such as a toy skunk, a toy soldier in a gas mask, a toy toilet, a roll of toilet paper or the like, the present invention device is presented as a toy bird in a small bird cage. Such a configuration is merely exemplary and should not be considered a limitation as to the appearance the present invention device can take.

Figure 1:
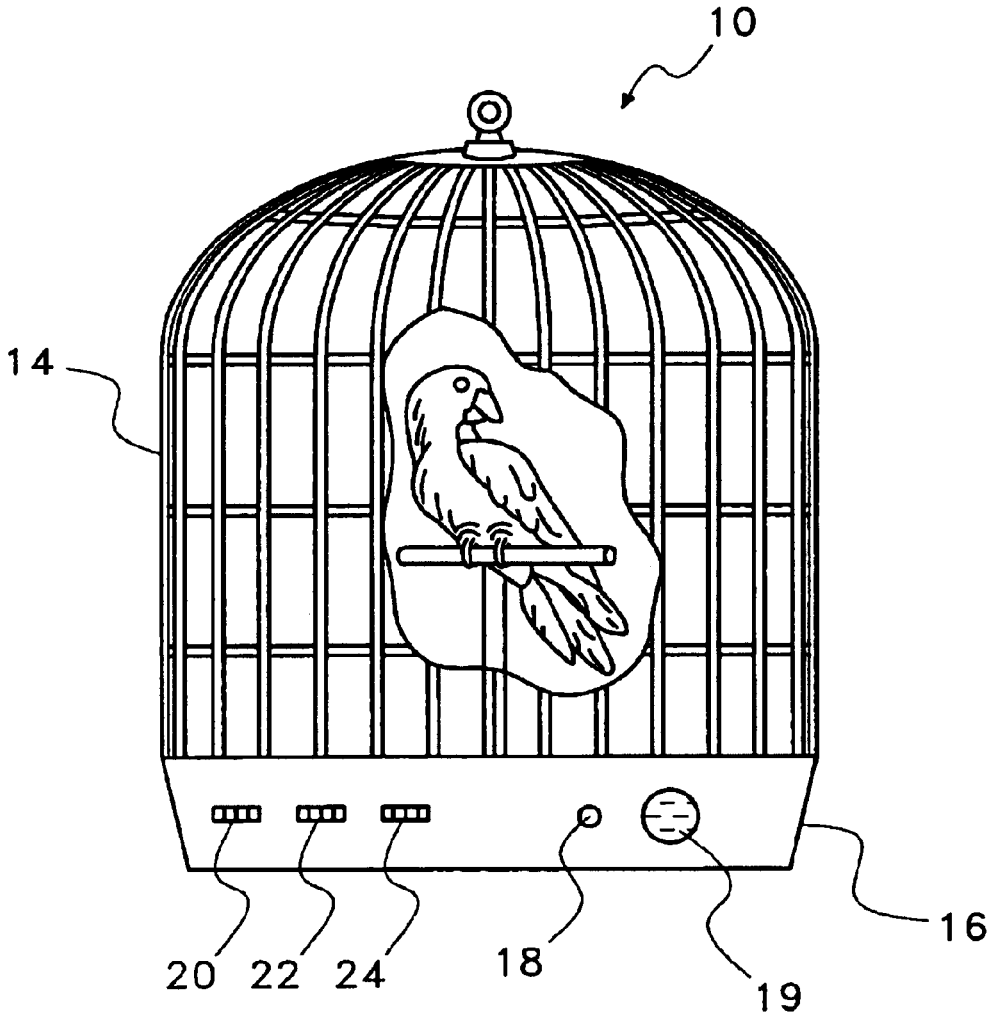
FIG. 1 is a perspective view of an exemplary embodiment of the present invention novelty device.

Referring to FIG. 1, an exemplary embodiment of the present invention amusement device 10 is shown. In this embodiment, the present invention device 10 is configured as a canary 12 in a birdcage 14. The configuration of a canary 12 in a birdcage 14 was selected because canaries were often used by miners to detect the presence of gas in coalmines. As such, the image of a canary in a birdcage already provides the impression that the device 10 is a gas detector.

The present invention device 10 contains a cage base 16 that forms the floor of the birdcage 14. The cage base 16 contains much of the electronics used in the device 10 as well as the batteries that power the device 10. On the exterior of the cage base 16 are located a gas intake aperture 18, a speaker aperture 19 and the operating controls of the device 10. The operating controls include an on/off switch 20. The operating controls may also include an optional volume control 22 and a message selection switch 24.

The presence of the gas intake aperture 18 on the cage base 16 enables ambient air to diffuse into the cage base 16 for detection. As will later be explained, a gas sensor that senses gas emitted with a bowel movement is present within the cage base 16. The speaker aperture 19 in the cage base 16 enables sound generated by an internal speaker to be clearly heard outside of the cage base 16.

Within the birdcage 14 is perched an artificial canary 12. To operate the present invention novelty device 10, the device 10 is placed in a bathroom at some point close to the toilet. When turned on, the device 10 samples the air surrounding the device 10 using an internal gas sensor. When elevated levels of methane are detected, or other gases emitted with human waste, the novelty device 10 activates automatically. Once activated, a humorous audible message is broadcast. The massage may say "What a stench! Somebody open the window! There are rules against cruelty to animals!" A countless number of messages can be used. The messages can be simple and benign or can be highly X-rated.

If the canary 12 in the birdcage is mechanically articulated, the canary 12 can be caused to move when the device 10 is activated and the message is broadcast. The canary 12 may drop over dead. Alternatively, the canary 12 can flap its wings and its beak can move in synchronization with the audible message being broadcast.

Figure 2:
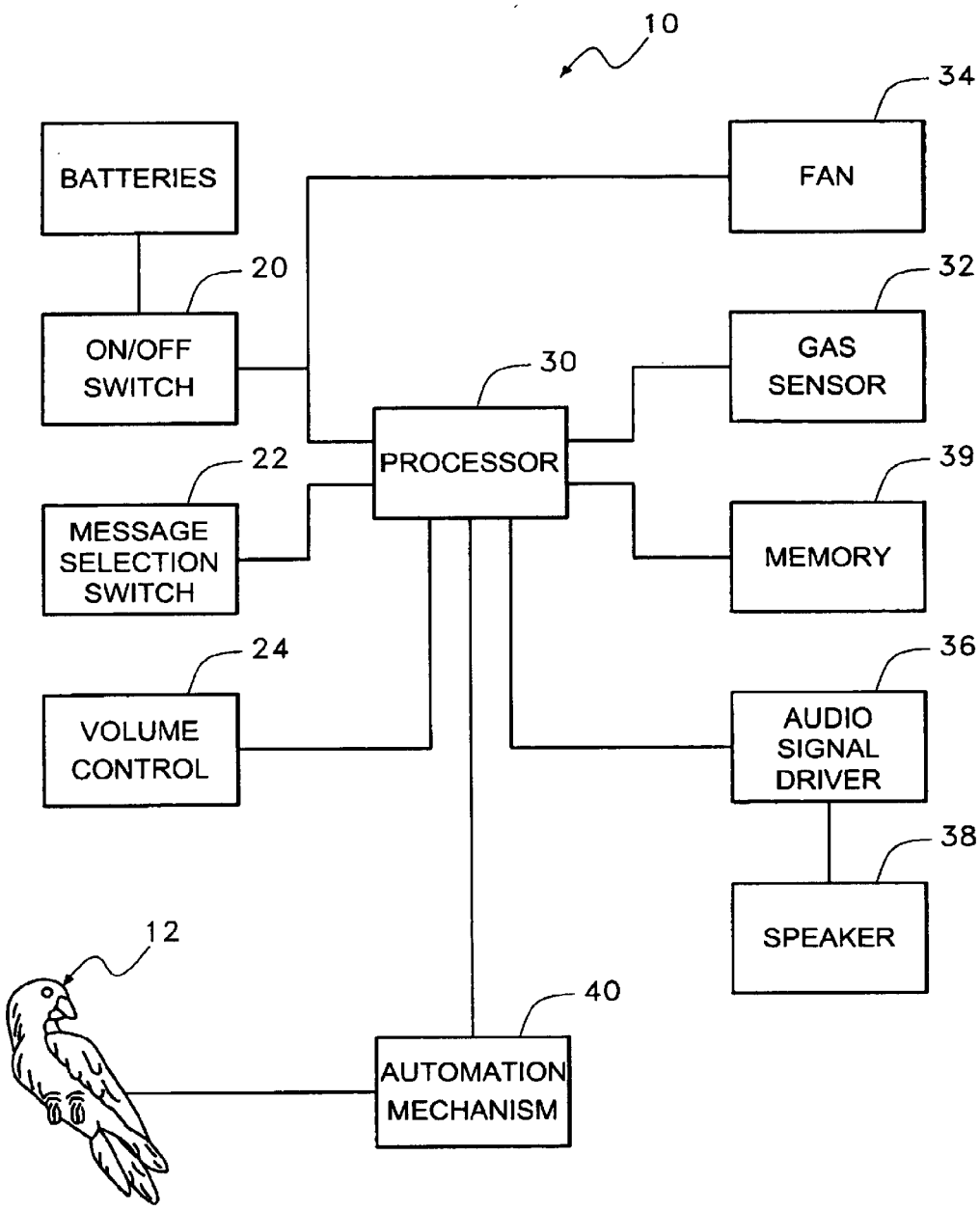
FIG. 2 is a schematic diagram of the electronic components of the present invention novelty device.

Referring to FIG. 2, it can be seen that the present invention device 10 contains a processor 30 that controls the electronic functions of the device 10. A gas detector 32 is coupled to the processor 30, wherein the processor 30 monitors the signal output of the gas sensor 32. When the gas sensor 32 detects a concentration of gas over a predetermined threshold level, the signal sent to the processor 30 by the gas sensor 32 is used as a triggering signal by the processor 30. The triggering signal causes the processor 30 to change the state of the overall device from a dormant state to an activated state.

The gas sensor 32 is preferably a methane detector. There are many methane gas detectors commercially available. Most any of these methane gas detectors can be adapted for use with the present invention device 10. However, human waste contains many gases besides methane that are found only in the air of a confined bathroom while being used. Any sensor can be used that is capable of rapidly detecting elevated levels of any of these other gases.

A small optional draw fan 34 may be provided near the gas sensor 32. The draw fan 34 can be used to actively draw ambient air past the gas sensor 32. In this manner, elevated waste product gases can be more rapidly detected.

The processor 30 activates an audio signal driver 36 once the gas sensor 32 detects elevated levels of gas. The audio signal driver 36 causes an audio message to be broadcast from a speaker 38. The audio message can be a fixed message or can be one of several messages that are retrieved from a memory 39. The message can be randomly retrieved from the memory 39 or can be preselected using the optional message selection switch 24.

Furthermore, if the canary 12 is mechanically articulated, the processor 30 activates the movement motors 40 that are interconnected to the canary 12. The movement motors 40 can cause the bird to drop dead, flap its wings, move its head or create any other type of movement.

As has been previously stated, the use of a canary 12 in a cage is merely exemplary and the present invention device 10 can be manufactured into many different configurations. The configurations can be humorous, such as a skunk in a gas mask. Alternatively, the configurations can be inconspicuous, such as a candle or a fake roll of toilet paper that would hardly be noticed on a bathroom counter. Rather, it should be understood that the heart of the present invention is an electronic assembly that can rapidly detect gases emitted with a bowel movement. The electronic assembly is embodied in an automated character or object. Once the gas is detected, an audible message is broadcast and movement is created in the character or object.

It will be understood that the present invention novelty device that is described and illustrated is merely exemplary and a person skilled in the art can make many variations to the shown embodiment. All such alternate embodiments and modifications are intended to be included within the scope of the present invention as defined below in the claims.

What is claimed is:

1. A novelty device, comprising:

an automated character;

a gas sensor for detecting at least one gas emitted with a bowel movement; and a speaker for transmitting an audible message, wherein said speaker transmits an audible message and said automated character moves when said gas sensor detects said at least one gas in ambient air at a concentration greater than a predetermined threshold.

2. The device according to claim 1, further including a processor coupled to said automated character, said gas sensor and said speaker, wherein said processor activates said automated character and said speaker when said gas sensor detects said at least one gas at a concentration greater than said predetermined threshold.

3. The device according to claim 2, wherein said automated character includes at least one motor that creates movement in said automated character, wherein said at least one motor is controlled by said processor.

4. The device to claim 1, further including a memory that contains a plurality of audible messages, wherein said audible message transmitted by said speaker is selected from said plurality of audible messages.

5. The device according to claim 4, further including a manually adjustable control for selecting said audible message from said plurality of audible messages.

6. The device according to claim 4, wherein said audible message is randomly selected from said plurality of audible messages.

7. The device according to claim 1 further including a fan for actively drawing ambient air past said gas detector.

8. The device according to claim 1, further including a base structure on which said automated character stands, wherein said gas sensor and said speaker are disposed in said base structure.

9. The device according to claim 1, wherein said automated character is a bird.

10. A novelty device, comprising:

a housing;

a circuit supported by said housing, wherein said circuit includes a gas sensor for detecting gas emitted with a bowel movement, and a speaker activated by said gas sensor for emitting at least one audible message when said gas sensor detects said gas; and an automated object that contains at least one motor that causes movement in said automated object, wherein said at least one motor is activated when said gas sensor detects said gas.

11. The device according to claim 10, wherein said circuit further includes a memory that contains a plurality of audible messages, wherein said audible message transmitted by said speaker is selected from said plurality of audible messages.

12. The device according to claim 11, further including a manually adjustable control for selecting said audible message from said plurality of audible messages.

13. The device according to claim 11, wherein said audible message is randomly selected from said plurality of audible messages.

14. The device according to claim 10, further including a fan for actively drawing ambient air past said gas detector.

15. The device according to claim 10, wherein said gas detector is a methane gas detector.

16. A method of operation for a novelty device, comprising the steps of:

providing an automated character;

sensing ambient air surrounding said automated character for gas emitted with a bowel movement;

emitting an audible message when said gas is detected;

causing motion in said automated character when said gas is detected.

* * * * *